US011266255B1

(12) United States Patent
Johnson et al.

(10) Patent No.: US 11,266,255 B1
(45) Date of Patent: Mar. 8, 2022

(54) RETAIL DISPLAY UNIT WITH REMOVABLE LIDS

(71) Applicant: Target Brands, Inc., Minneapolis, MN (US)

(72) Inventors: Jason W. Johnson, Wayzata, MN (US); Blake M. Johnson, St. Paul, MN (US); Jeremiah J. Albrecht, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 17/089,997

(22) Filed: Nov. 5, 2020

(51) Int. Cl.
*A47F 5/00* (2006.01)

(52) U.S. Cl.
CPC ..... *A47F 5/0025* (2013.01)

(58) Field of Classification Search
CPC ..... A47F 5/0062; A47F 7/0078; A47F 7/286; A47F 7/145; A47F 3/14; A47F 5/0025; A47F 7/0007; A47F 5/005; A47F 5/0018; A47F 5/0043; A47F 5/16; A47F 7/146; A47F 7/283; A47F 7/0028; A47F 5/114; A47F 5/0081; A47F 7/163; A47G 7/041; A47B 87/0269; A47B 73/00; A47B 87/0207
USPC ..... 211/85.26
See application file for complete search history.

(56) References Cited

U.S. PATENT DOCUMENTS 895,867 A * 8/1908 Kirk ..... B65F 1/141 211/84
1,078,248 A 11/1913 Buchner
1,514,055 A 11/1924 Lawson
1,523,875 A * 1/1925 Iseman ..... A47F 5/0018 108/101
1,823,396 A * 9/1931 Goulet ..... A47F 5/0025 211/128.1
1,887,300 A * 11/1932 Goldstein ..... A47F 3/145 220/212
2,279,484 A 4/1942 Munshower
2,850,170 A * 9/1958 Palmer ..... A47F 5/01 211/84
3,290,108 A 11/1964 Beckman et al.
3,650,381 A * 3/1972 Weindling ..... A47F 5/08 206/742
3,688,707 A 9/1972 White
3,712,521 A * 1/1973 Tanner ..... D05B 91/14 223/107
3,926,314 A * 12/1975 Dogliotti ..... A47F 5/00 211/85.17

(Continued)

*Primary Examiner* — Hiwot E Tefera

(74) *Attorney, Agent, or Firm* — Leanne Taveggia Farrell; Westman, Champlin & Koehler, P.A.

(57) ABSTRACT

A retail display unit including a riser having at least one tier and having a vertical rise, a horizontal width and a horizontal length. At least one removable lid has a first configuration and a second configuration. In the first configuration, a width of the removable lid covers at least a portion of the horizontal width of the at least one tier and a length of the removable lid covers at least a portion of the horizontal length of the at least one tier. In the second configuration, the removable lid is located in a pocket that is defined by a pocket depth that is a portion of the vertical rise of the at least one tier, a pocket width that is a portion of the horizontal width of the at least one tier and a pocket length that is at least a portion of the horizontal length of the at least one tier.

20 Claims, 12 Drawing Sheets

(56) References Cited

U.S. PATENT DOCUMENTS

| | | | | | |
|---|---|---|---|---|---|
| 4,458,501 | A | | 7/1984 | Kooy | |
| 4,726,477 | A | * | 2/1988 | Martin | A47F 5/01 211/128.1 |
| 4,899,487 | A | * | 2/1990 | Brownlee | A47F 7/0071 47/41.01 |
| 5,060,580 | A | | 10/1991 | Shaw | |
| 5,095,649 | A | * | 3/1992 | Brownlee | A47G 7/041 47/41.01 |
| 5,192,122 | A | * | 3/1993 | Hill | A47B 49/00 312/267 |
| 5,357,876 | A | | 10/1994 | Kniefel et al. | |
| 5,692,445 | A | * | 12/1997 | Winer | A47B 3/0912 108/100 |
| D400,030 | S | | 10/1998 | Wetzel | |
| 5,860,289 | A | * | 1/1999 | Wetzel | A47F 7/0078 62/255 |
| 6,128,912 | A | * | 10/2000 | Wetzel | A47F 3/0447 62/256 |
| 6,726,032 | B2 | * | 4/2004 | Sullivan | A47F 5/108 211/50 |
| 8,051,783 | B1 | | 11/2011 | Hoskinson | |
| 8,651,029 | B2 | | 2/2014 | Huang et al. | |
| 8,919,507 | B2 | | 12/2014 | Parizek et al. | |
| 2002/0157308 | A1 | * | 10/2002 | Hanis | A47F 7/0078 47/41.01 |
| 2006/0043038 | A1 | * | 3/2006 | Wetzel | A47G 7/044 211/88.03 |
| 2006/0249059 | A1 | | 11/2006 | Gagne | |
| 2006/0261023 | A1 | | 11/2006 | Goth | |
| 2015/0314947 | A1 | * | 11/2015 | Mackie | A47B 96/067 206/307 |
| 2019/0197602 | A1 | * | 6/2019 | Scalzi | A47F 5/005 |
| 2020/0138205 | A1 | * | 5/2020 | Ward | A01K 63/06 |

* cited by examiner

RETAIL DISPLAY UNIT WITH REMOVABLE LIDS

BACKGROUND

Retail stores use a variety of retail display units to present products to customers for purchase. These display fixtures can support the product or products, indicate the product price, and include signage for highlighting the product. Exemplary display structures include shelves, risers, bins, buckets and other similar structures.

The discussion above is merely provided for general background information and is not intended to be used as an aid in determining the scope of the claimed subject matter.

SUMMARY

A retail display unit includes a riser having at least one tier. The at least one tier has a vertical rise, a horizontal width and a horizontal length. At least one removable lid has a first configuration and a second configuration. In the first configuration, a width of the removable lid covers at least a portion of the horizontal width of the at least one tier and a length of the removable lid covers at least a portion of the horizontal length of the at least one tier. In the second configuration, the removable lid is located in a pocket that is defined by a pocket depth that is a portion of the vertical rise of the at least one tier, a pocket width that is a portion of the horizontal width of the at least one tier and a pocket length that is at least a portion of the horizontal length of the at least one tier.

A retail display unit comprising includes at least one tier having a vertical rise, a horizontal width and a horizontal length and at least one loose panel having a length and a width and being configurable into a display shelf configuration and a stowed configuration. In the display shelf configuration, the at least one loose panel provides the at least one tier with a display shelf by having the length of the at least one loose panel be located along at least a portion of the horizontal length of the at least one tier and the width of the at least one loose panel be located along at least a portion of the horizontal width of the at least one tier. In the stowed configuration, the at least one panel is stowed in a cavity in the at least one tier. The cavity is defined by a cavity depth that is a portion of the vertical rise of the at least one tier, a cavity width that is a portion of the horizontal width of the at least one tier and a cavity length that is at least a portion of the horizontal length of the at least one tier.

A method of configuring a retail display unit includes providing at least one loose panel on a tier of a riser in a position so as to act as a display shelf. In this position, a length of the at least one loose panel is located along at least a portion of a horizontal length of the tier and a width of the at least one loose panel be located along at least a portion of a horizontal width of the tier. The at least one loose panel is moved and stowed in a cavity in the tier. The cavity is defined by a cavity depth that is a portion of a vertical rise of the tier, a cavity width that is a portion of the horizontal depth of the tier and a cavity length that is at least a portion of the horizontal length of the tier.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The retail display unit described in detail below is a freestanding display fixture mounted on casters for ease of mobility on a store floor. The retail display unit includes at least one tier. Each tier includes a removable lid or loose panel that in a first or display shelf configuration acts as a display shelf on the tier. In a second or stowed configuration, the lid or panel is removed from acting as a display shelf and is stowed in a pocket or cavity in the at least one tier to expose a recessed bucket or bin for receiving and displaying retail merchandise.

Figure 1:
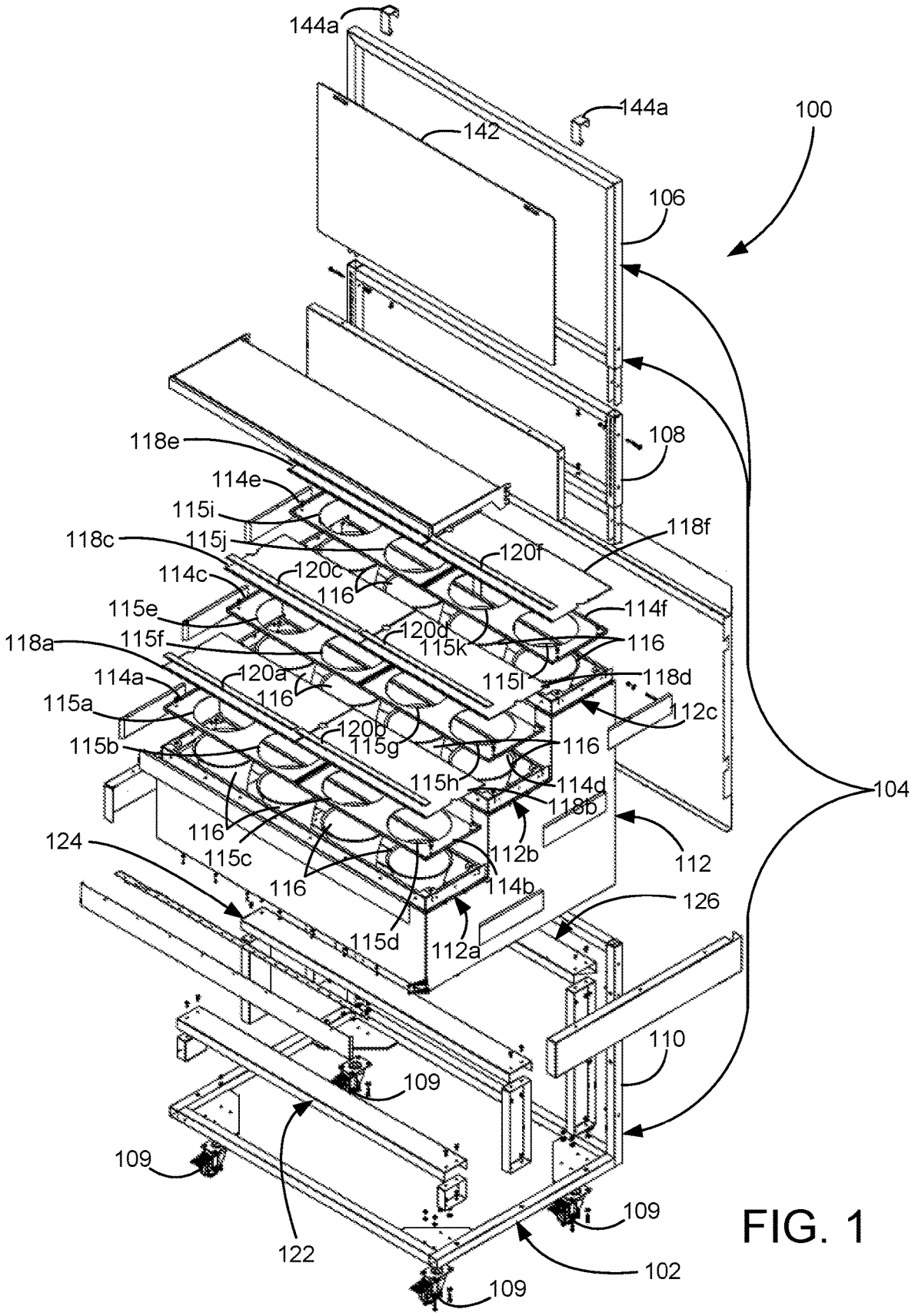
FIG. 1 is an exploded perspective view of a retail display unit according to an embodiment.
Figure 2:
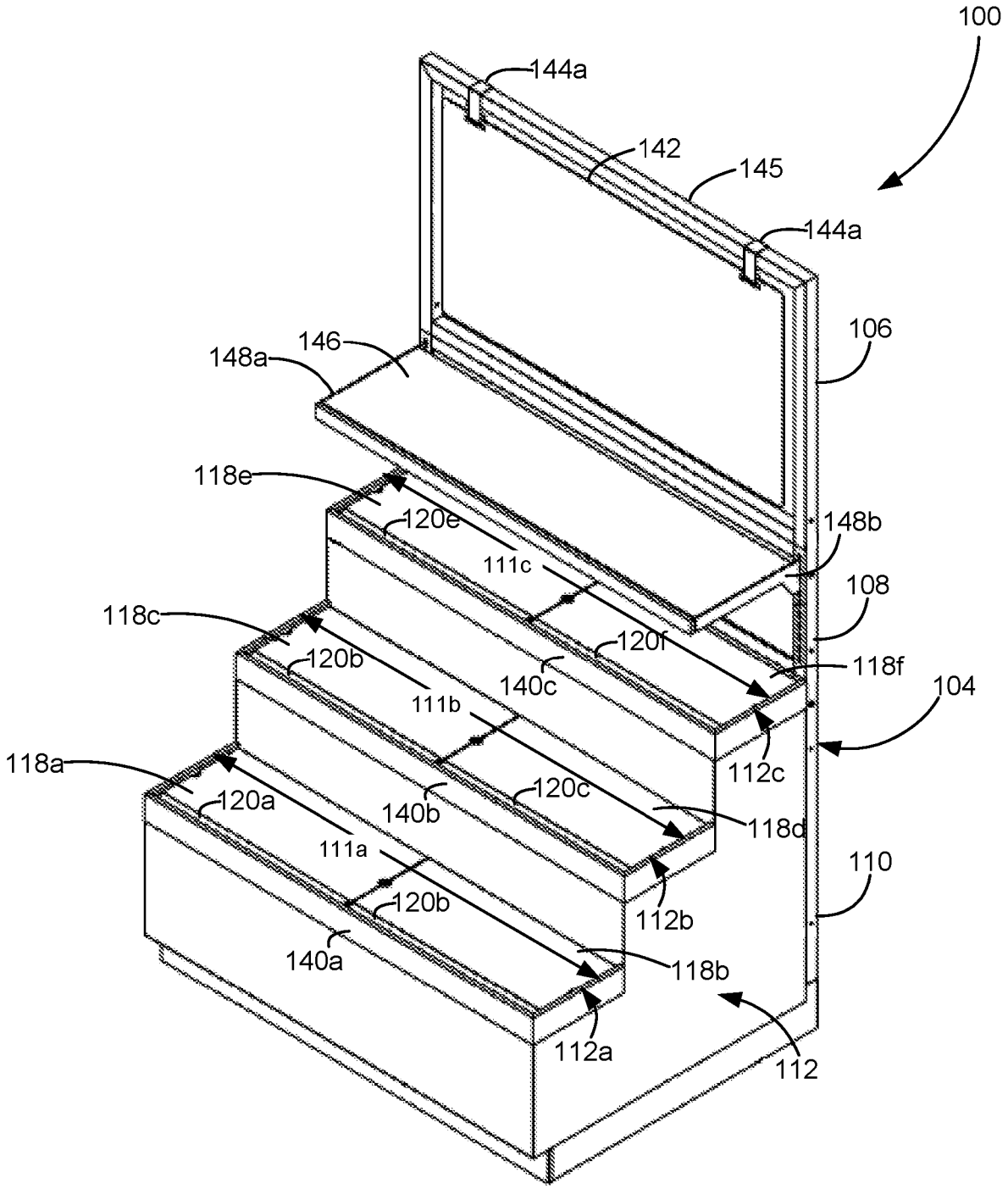
FIG. 2 is an assembled front perspective view of FIG. 1.
Figure 3:
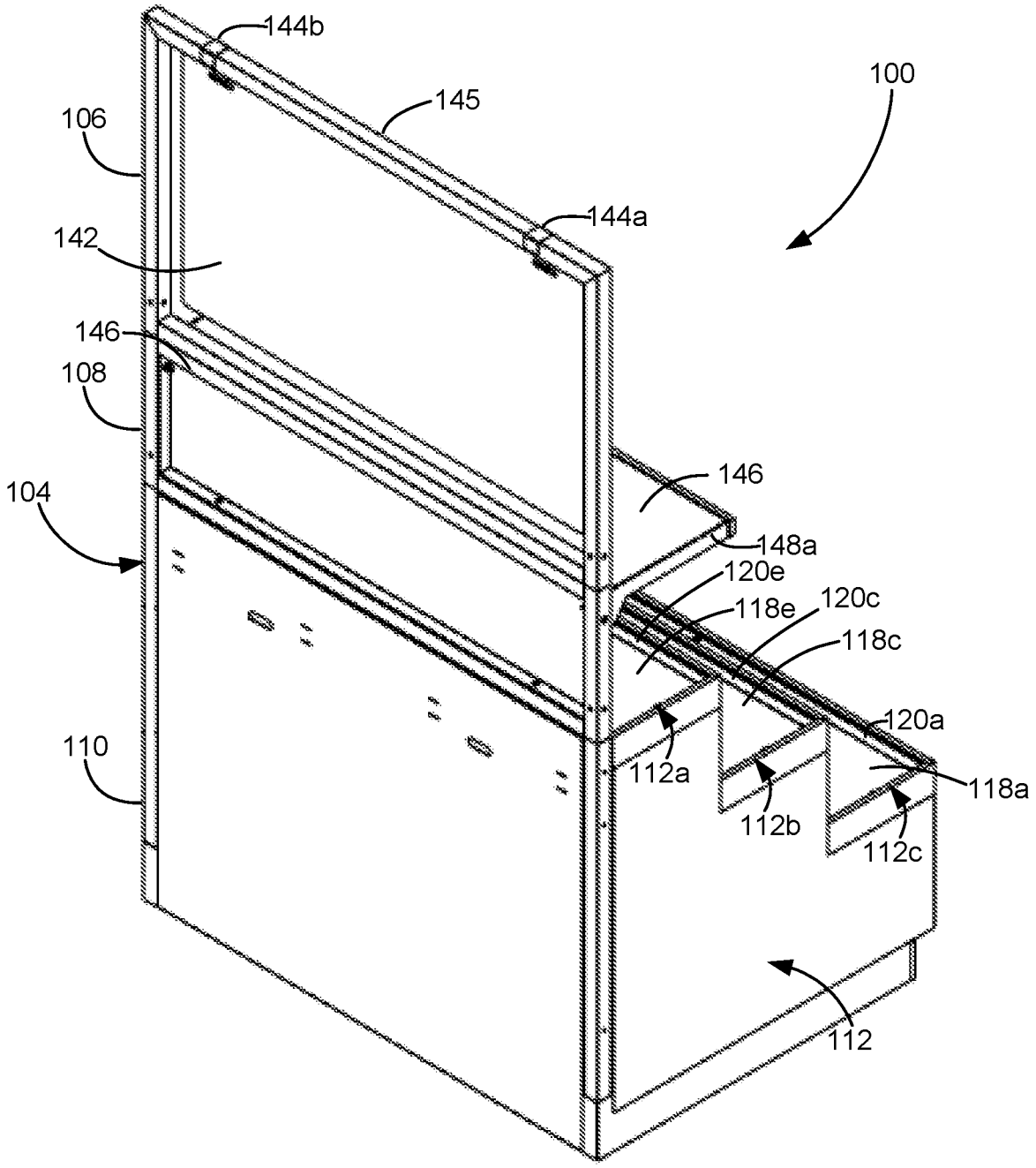
FIG. 3 is a back perspective view of FIG. 2.
Figure 4:
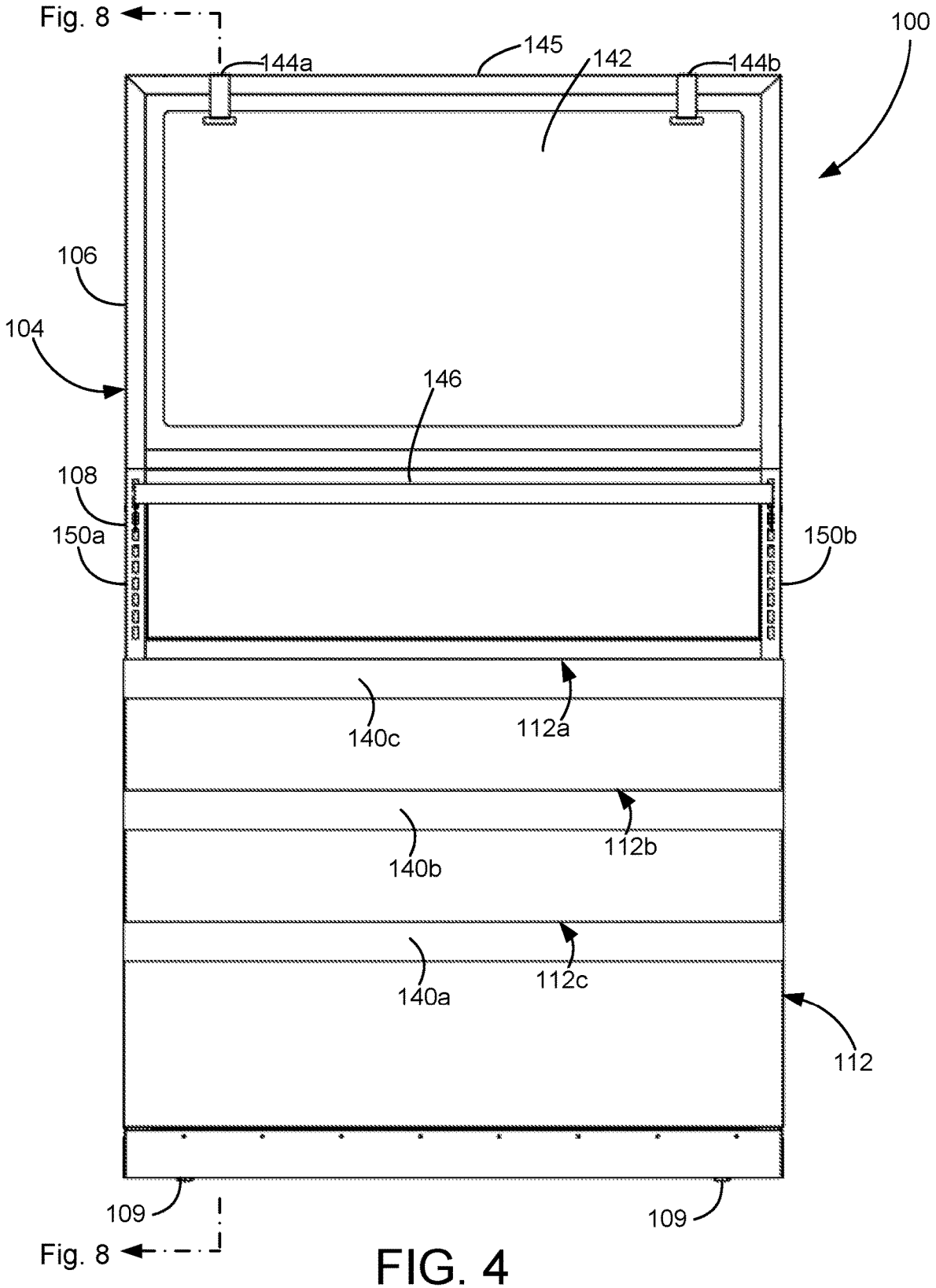
FIG. 4 is front view of FIG. 2.
Figure 5:
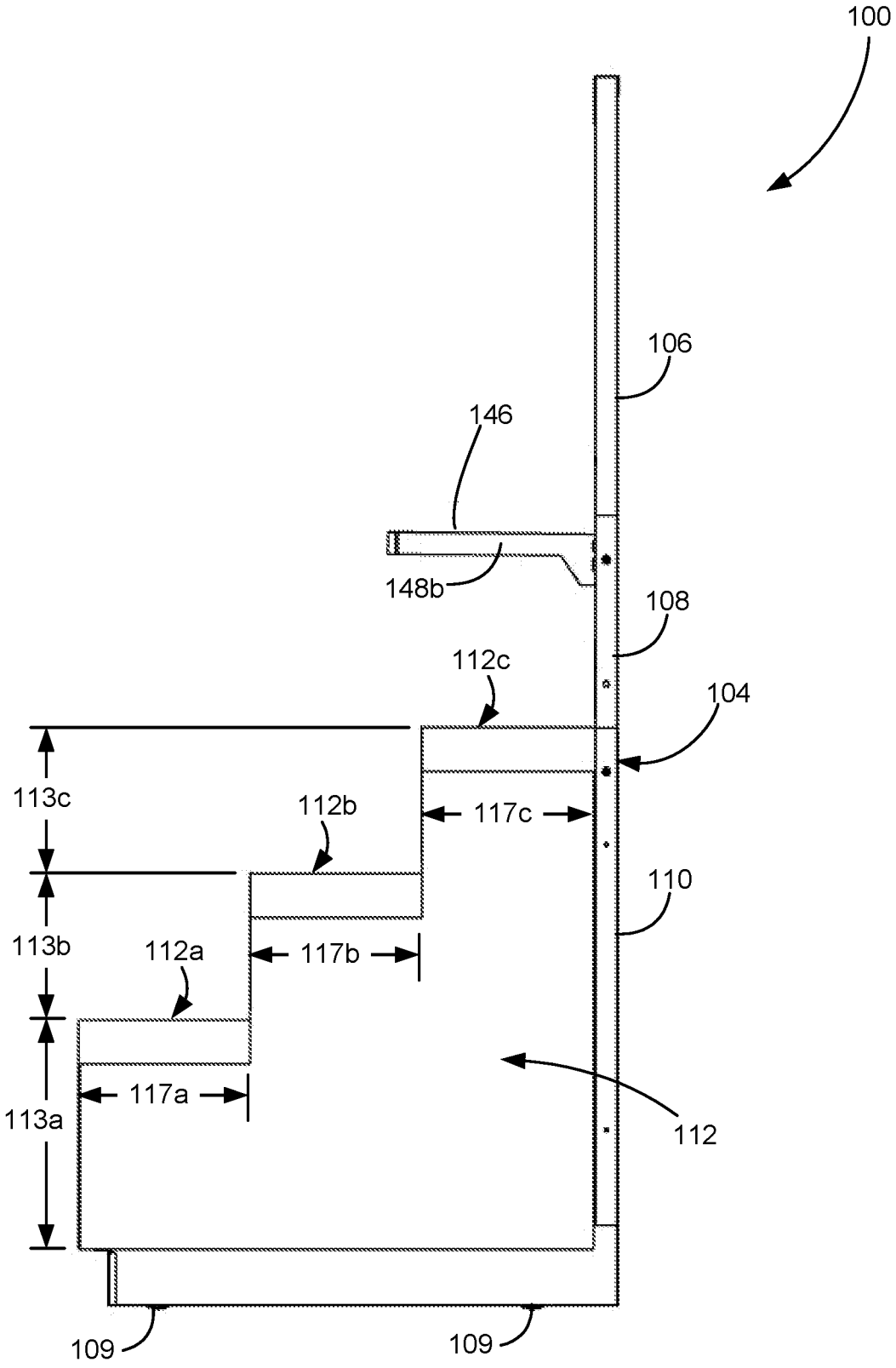
FIG. 5 is a right side view of FIG. 2.
Figure 6:
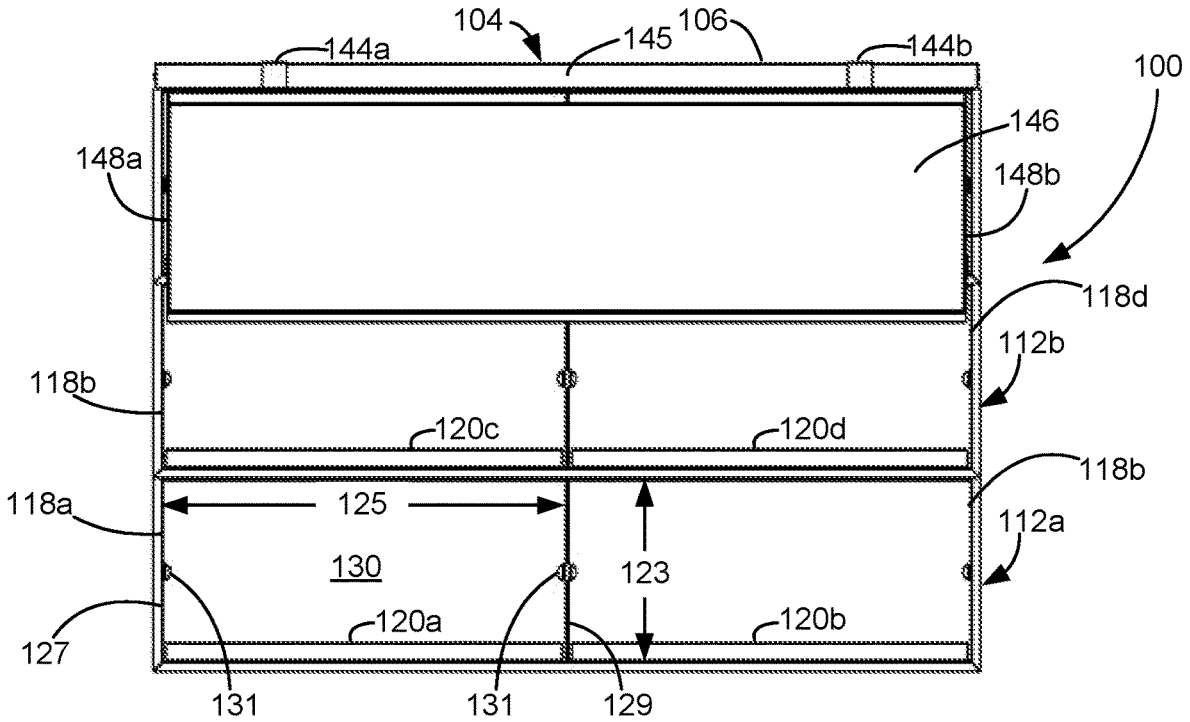
FIG. 6 is a top view of FIG. 2
Figure 7:
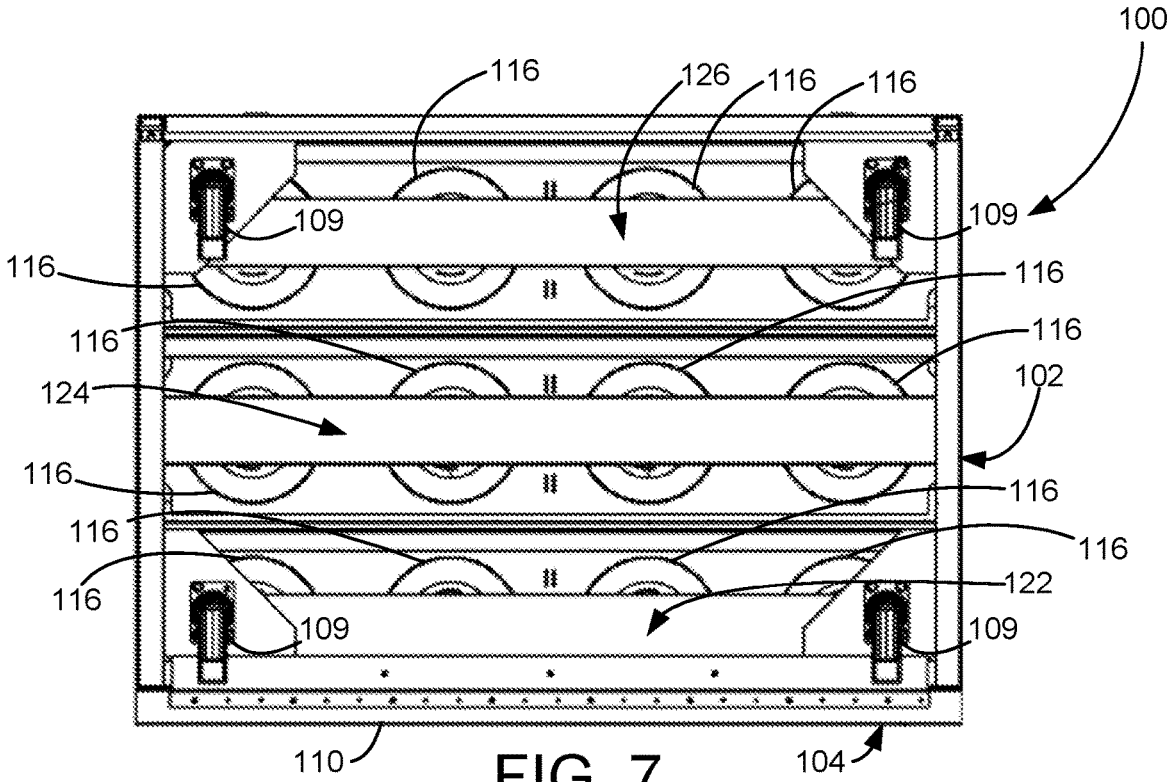
FIG. 7 is a bottom view of FIG. 2.

FIG. 1 is an exploded perspective view of a retail display unit 100 according to an embodiment. FIG. 2 is an assembled front perspective view of the retail display unit 100, FIG. 3 is a back perspective view, FIG. 4 is a front view, FIG. 5 is a right side view (the left side view being a mirror image), FIG. 6 is a top view and FIG. 7 is a bottom view of FIG. 2. Retail display unit 100 includes a base support frame 102, a back support frame 104 and a riser 112. Back support frame 104 includes a top frame portion 106, a center frame portion 108 and a bottom frame portion 110. Bottom frame portion 110 is mounted to base support frame 104 at a back of base support frame 104 to form an L-shaped freestanding support frame. A plurality of casters 109 are mounted to a bottom of base support frame 104 to provide the L-shaped freestanding support frame with mobility about a store floor.

Riser 112 includes at least one tier 112*a-c*. As illustrated in the figures, riser 112 includes a first or lower tier 112*a*, a second or center tier 112*b* and a third or upper tier 112*c*. Each tier 112*a*, 112*b* and 112*c* is defined by a horizontal length 111*a*, 111*b* and 111*c* (FIG. 2), vertical height or rise 113*a*, 113*b* and 113*c* (FIG. 5) and a horizontal width 117*a*, 117*b* and 117*c* (FIG. 5). Each tier 112*a-c* includes at least one pan 114*a-f* that has at least one opening 115. As illustrated, first tier 112*a* includes pan 114*a* having openings 115*a* and 115*b* and pan 114*b* having openings 115*c* and 115*d*. Pans 114*a* and 114*b* are positioned adjacent to each other. Second tier 112*b* includes pan 114*c* having openings 115*e* and 115*f* and pan 114*d* having openings 115*g* and 115*h*. Pans 114*c* and 114*d* are positioned adjacent to each other.

Third tier 112*c* includes pan 114*e* having openings 115*i* and 115*j* and pan 114*f* having openings 115*k* and 115*l*. Pans 114*e* and 114*f* are positioned adjacent to each other. Each of the openings in the pans provide access to a hollow interior of riser 112. This hollow interior is defined by the horizontal lengths 111*a*, 111*b*, 111*c*, vertical heights or rises 113*a*, 113*b* and 113*c* and horizontal depths 117*a*, 117*b* and 117*c* of tiers 112*a*, 112*b* and 112*c*.

Figure 8:
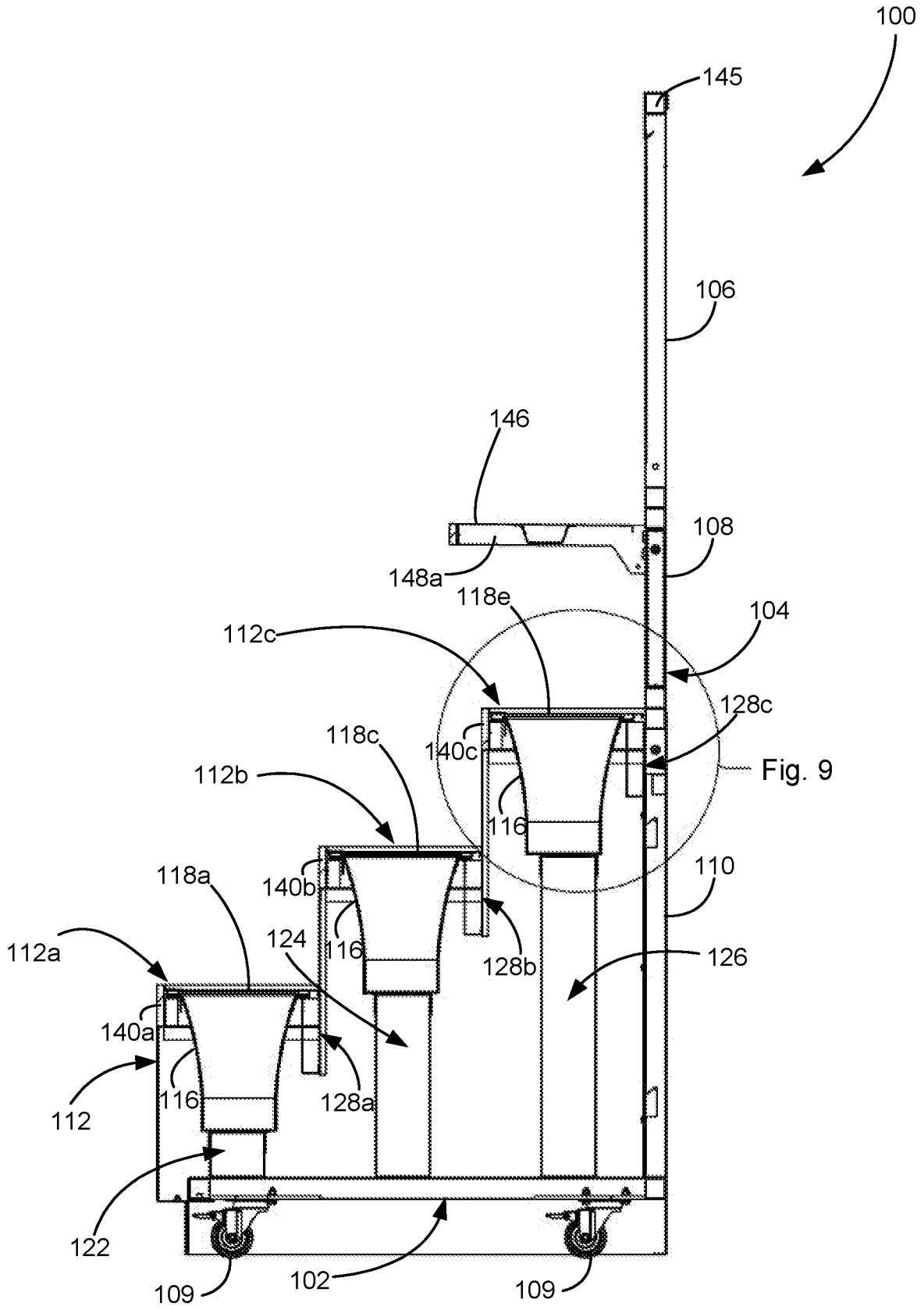
FIG. 8 is a section view taken through the section line as indicated in FIG. 4.
Figure 9:
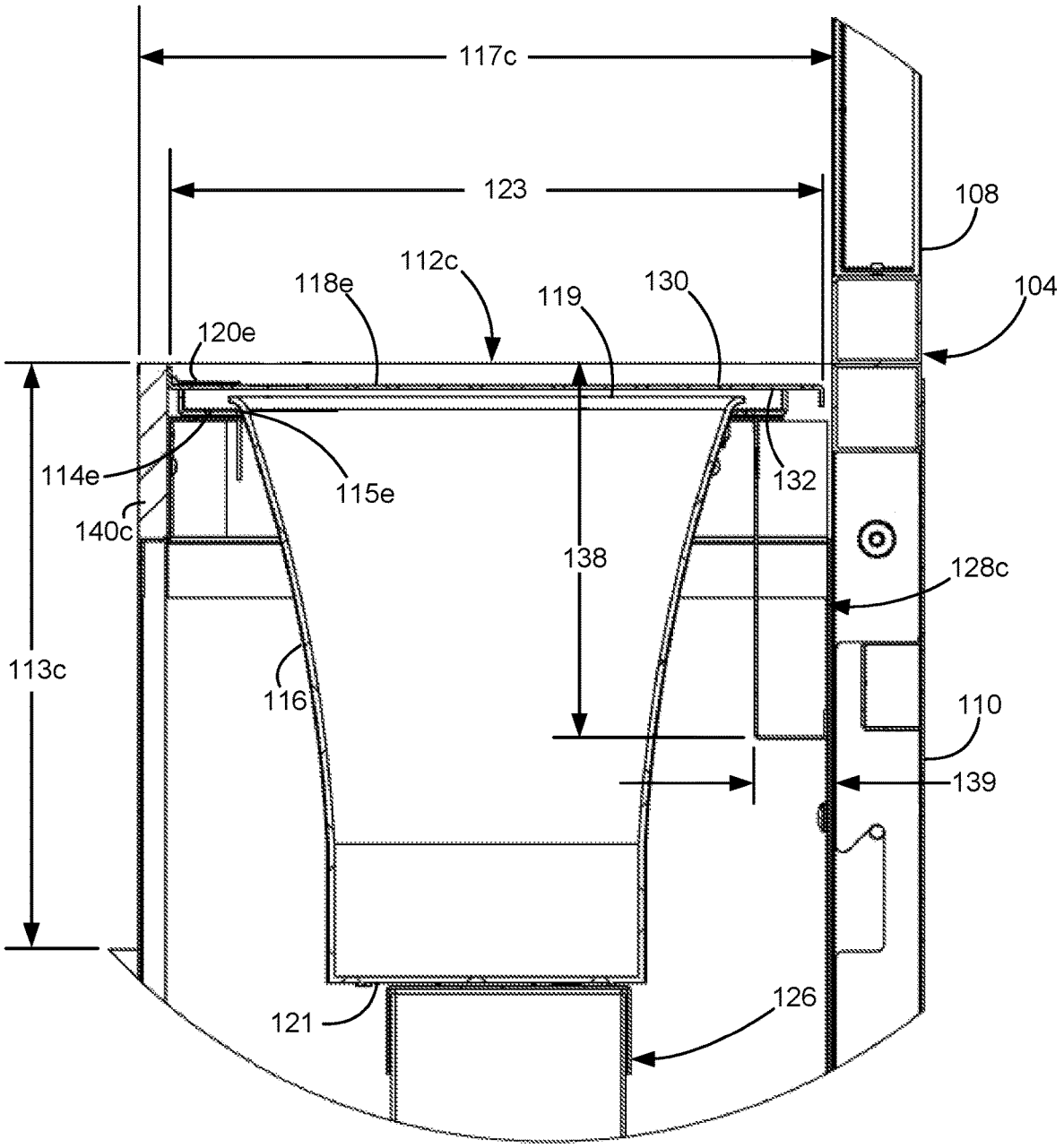
FIG. 9 is an enlarged view of a portion of the section view as indicated in FIG. 8.

FIG. 8 illustrates a section view of retail display unit 100 taken through the section line indicated in FIG. 4 and FIG. 9 is an enlarged view of a portion of the section view as indicated in FIG. 8. As shown, each opening in pans 114*a-f* may provide support for holding a bucket or bin 116 that is configured to display retail merchandise. Each bucket or bin 116 (also shown in FIG. 1) extends into the hollow interior of riser 112 and includes an open top lip 119 and an enclosed bottom 121. Open top lip 119 of each bucket or bin 116 is supported by pan 114 and enclosed bottom 121 of each bucket or bin 116 is further supported by one of first tier support 122, second tier support 124 and third tier support 126 depending on the location of bucket or bin 116.

As also illustrated in FIGS. 8 and 9, positioned over each pan 114 and each bucket or bin 116 is a removable lid or loose panel 118. With additional reference to FIGS. 1-4 and 6-7, first tier 112*a* includes removable lids or loose panels 118*a* and 118*b* positioned adjacent to each other and configured to cover pans 114*a* and 114*b*, respectively. Second tier 112*b* includes removable lids or loose panels 118*c* and 118*d* positioned adjacent to each other and configured to cover pans 114*c* and 114*d*, respectively. Third tier 112*c* includes removable lids or loose panels 118*e* and 118*f* positioned adjacent to each other and configured to cover pans 114*e* and 114*f*, respectively.

With reference to FIG. 6, each removable lid or loose panel 118*a-f* includes a width 123, a length 125, opposing widthwise sides 127 and 129, a first surface 130 (also shown in FIG. 9) and an opposing second surface 132 (FIG. 9). At the front of first surface 130 of each removable lid or loose panel 118*a-f* includes a label holder 120*a-f*. Widthwise sides 127 and 129 of each removable lid or loose panel 118*a-f* includes a concave portion 131 (FIG. 6) that provides finger holds to lift the at least one removable lid or loose panel from over each pan. It should be realized that each tier may have one or any number of removable lids and is not limited the two removable lids as illustrated.

FIGS. 2-9 illustrate each removable lid 118*a-f* being in a first configuration or display shelf configuration on retail display unit 100. In the first or display shelf configuration, removable lids 118*a-f* are positioned on top of its corresponding tier 112*a*, 112*b* and 112*c* to cover pans 114*a-f* of retail display unit 100 so as to equip tiers 112*a-c* with display shelves for displaying retail merchandise. FIGS. 10-13 illustrate each removable lid or loose panel 118*a-f* being in a second configuration or stowed configuration on retail display unit 100. In the second or stowed configuration removable lids or loose panels 118*a-f* are moved from their first or display shelf configuration and stowed in a pocket or cavity 128*a-c* (FIGS. 8 and 9) at the back of its corresponding tier.

Figure 10:
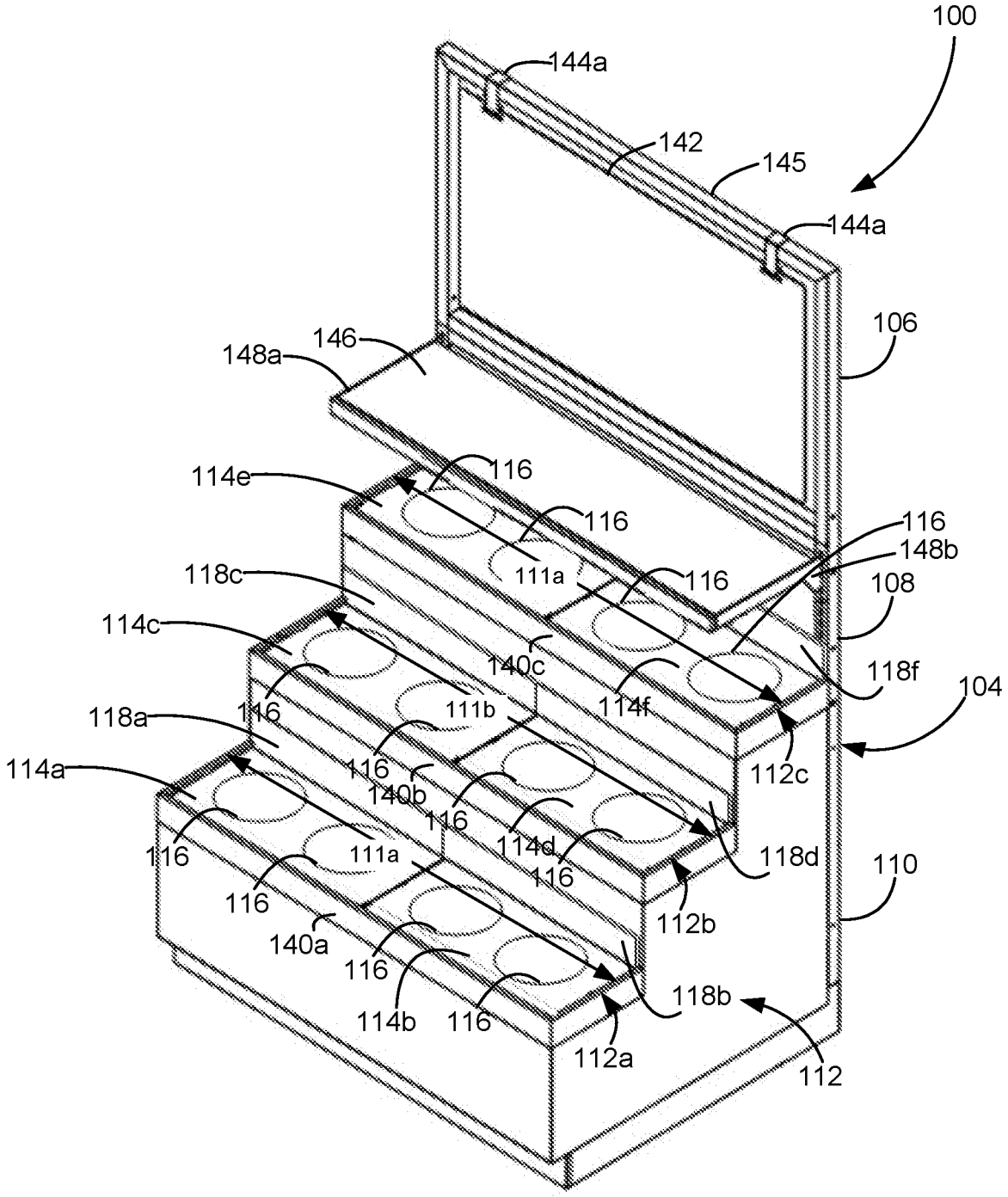
FIG. 10 is perspective view of the retail display unit with its lids or panels removed from their position as display shelves and stowed in pockets or cavities of the riser.
Figure 11:
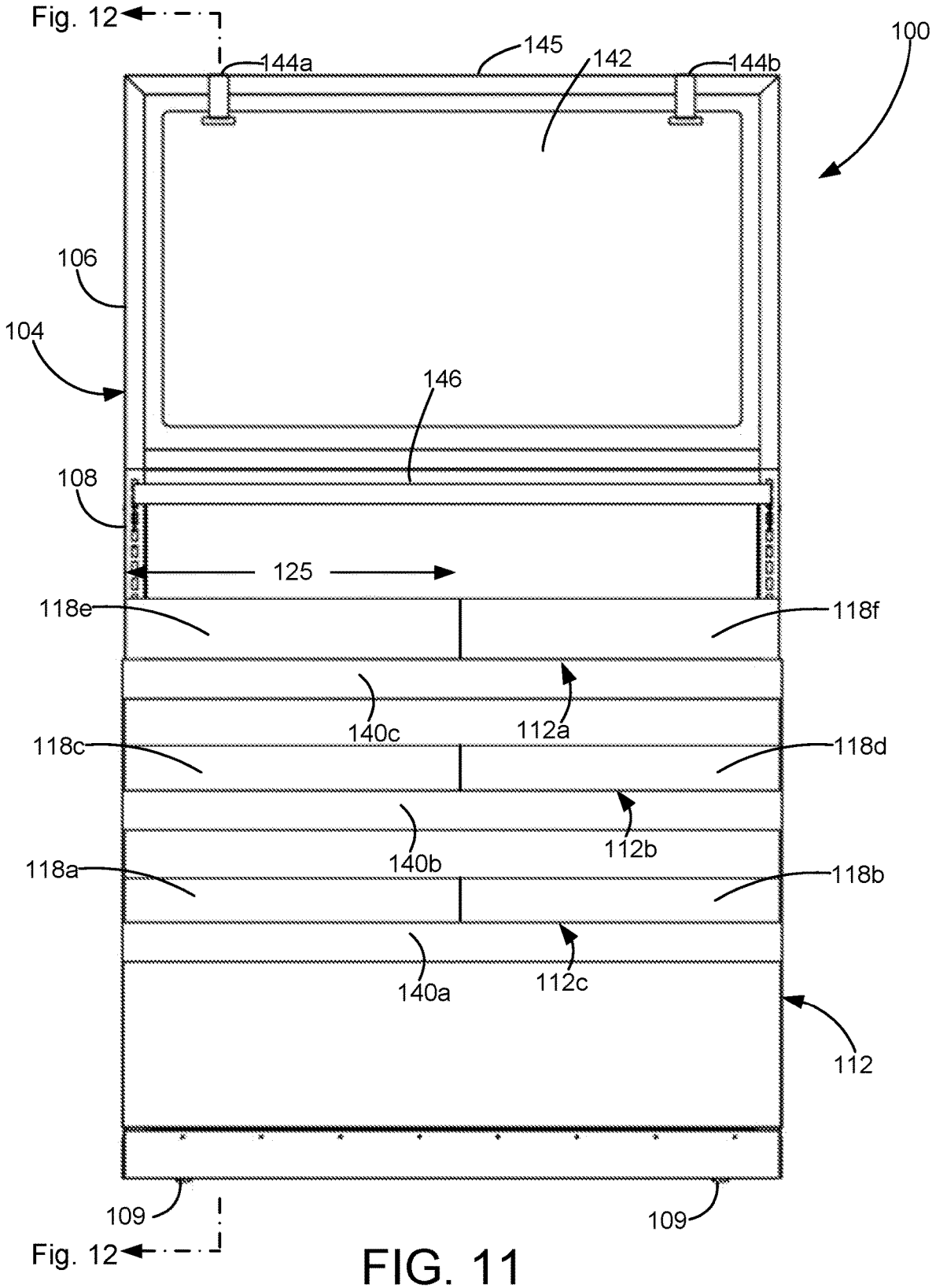
FIG. 11 is a front view of FIG. 10.
Figure 12:
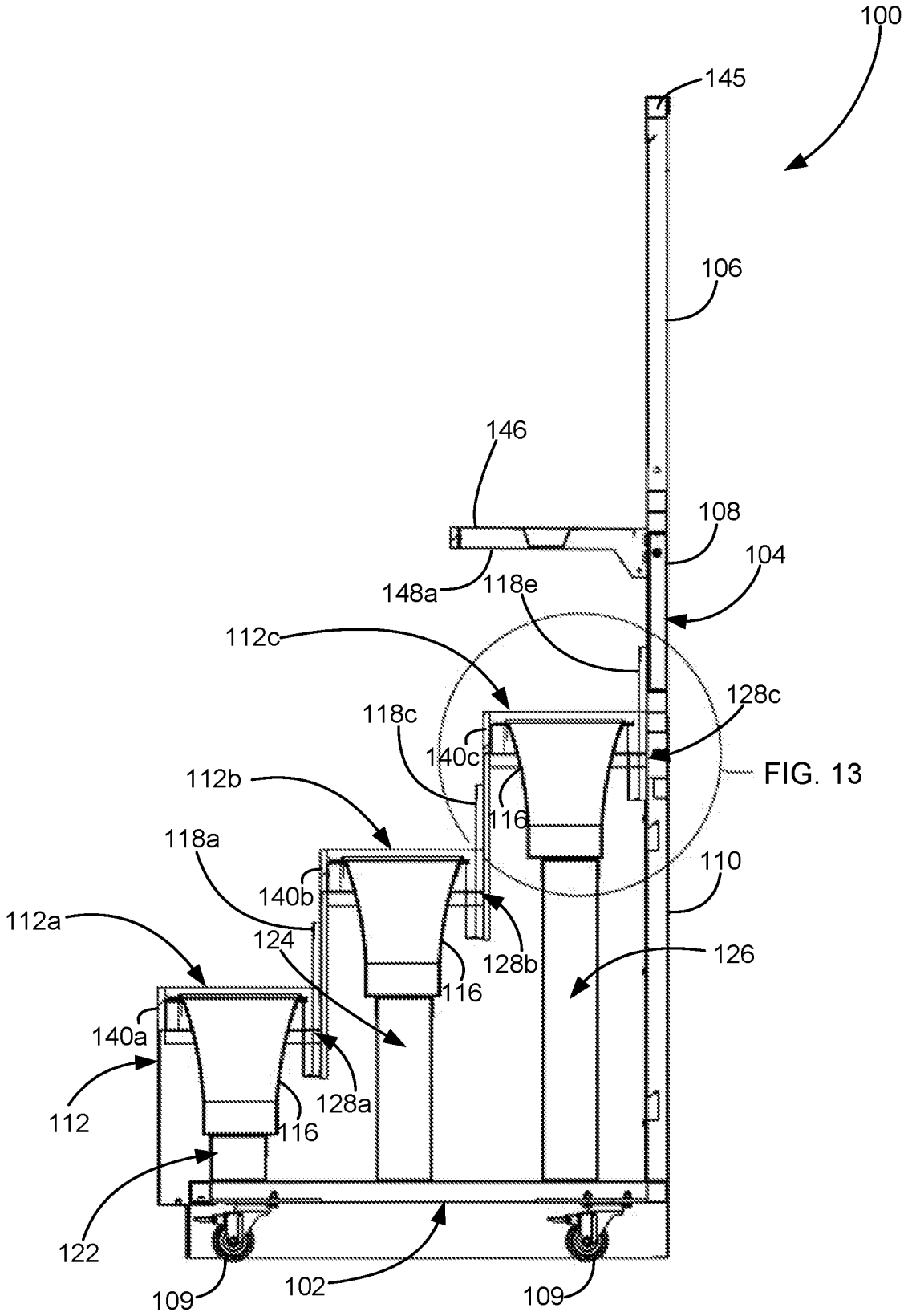
FIG. 12 is a section view taken through the section line as indicated in FIG. 11.
Figure 13:
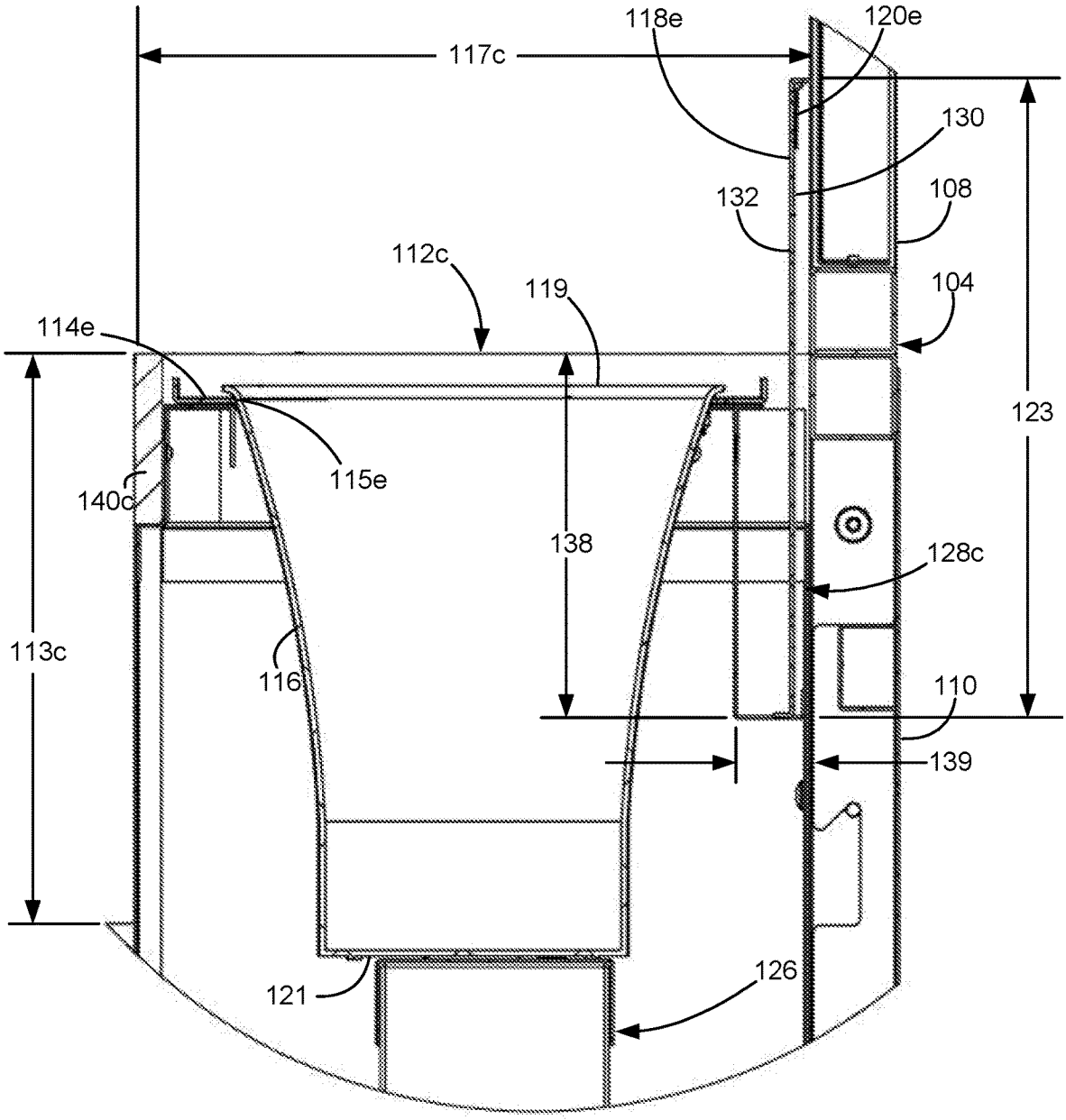
FIG. 13 is an enlarged view of a portion of the section view as indicated in FIG. 11.

FIG. 10 illustrates a perspective view of display unit 100 with removable lids or loose panels 118*a-f* in the second or stowed configurations. FIG. 11 illustrates a front view of FIG. 10, FIG. 12 illustrates a section view of FIG. 10 taken through the section line in FIG. 11 and FIG. 13 illustrates an enlarged view of a portion of FIG. 12. As illustrated in FIGS. 10-13, removable lids or loose panels 118*a-f* have all been moved from their first or display shelf configurations to their second or stowed configurations. More specifically, removable lids or loose panels 118*a-f* are being stored in pockets or cavities 128*a-c* of corresponding tiers 112*a-c* to reveal buckets or bins 116 being held in openings 115*a-f* (FIG. 1) of pans 114*a-f*. Each pocket or cavity 128*a*, 128*b* and 128*c* may extend the length 111*a-c* of each tier 112*a-c*, however, in other embodiments each tier 112*a-c* may have more than one pocket or cavity and may or may not include a pocket or cavity for each removable lid or loose panel associated with each tier. In one embodiment, all of removable lids or loose panels 118*a-f* of retail display unit 100 may be in the second or stowed configuration as illustrated in FIGS. 10-13. However, in other embodiments, only one or more removable lids or loose panes 118*a-f* may be in the second or stowed configuration. For example, removable lids or loose panels 118*a, c* and *e* may be placed in the second or stowed configuration to reveal bins or buckets 116 while removable lids or loose panels 118*b, d* and *f* are left in the first or display shelf configuration to act as display shelves. In this example, each tier includes a removable lid or loose panel in the first or display shelf configuration and a removable lid loose panel in the second or stowed configuration. In another example, all removable lids or loose panels on one or two of the tiers may be placed in the second or stowed configuration to reveal bins or buckets 116 while other removable lids or loose panels on other tiers are left in the first or display shelf configuration to act as display shelves. In yet another example, only one removable lid or loose panel is placed in the second or stowed configuration and all other removable lids or loose panels on the retail display unit are left in the first or display shelf configuration.

Each pocket or cavity 128*a-c* includes a pocket or cavity depth 138 (FIGS. 9 and 13). Depth 138 is the distance pocket or cavity 128*a-c* is recessed from the top of corresponding tiers 112*a-c*. Pocket or cavity depth 138 is less than vertical height or rise 113*a-c* of the corresponding tiers 112*a-c*. In addition, each pocket has a pocket or cavity width 139 (FIGS. 9 and 13) and a pocket or cavity length that is at least a portion of horizontal length 111*a-c* of tiers 112*a-c*. In the embodiment illustrated in FIGS. 2-13, the pocket or cavity length is similar to the horizontal length 111*a-c* of tiers 112*a-c*.

To move removable lids 118*a-e* from pans 114*a-f*, each lid 118*a-f* is lifted at one or both of concave portions 131 and rotated backwards to be slid into pocket or cavity 128*a-c*. In this way, first surfaces 130 of each of lids or panels 118*a-f* face upwardly in the first or display shelf configuration (FIGS. 8 and 9) and first surfaces 130 of each of lids or panels 118*a-f* face backwardly when positioned in the second or stowed configuration (FIGS. 12 and 13) Likewise, second opposing surfaces 132 of each of the lids or panels 118*a-f* face downwardly in the first or display shelf configuration (FIGS. 8 and 9) and second surfaces 132 of each of lids or panels 118*a-f* face forwardly when positioned in the second or stowed configuration (FIGS. 12 and 13).

When a removable lid or loose panel is in the first or display shelf configuration as illustrated by lid or panel 118*e* in FIG. 9, width 123 of the lid or panel is oriented along the same direction as horizontal width 117*c* of tier 112*c*, as is the case for all removable lids 118*a-f*. Furthermore, when a removable lid or loose panel is in the first or display shelf configuration as illustrated by lid or panel 118*e* in FIGS. 2-9, length 125 of the lid or panel is oriented along the same direction as horizontal length 111*c* of tier 112*c*, as is the case for all removable lids 118*a-f*. However, when a removable lid or loose panel is in the second or stowed configuration as illustrated by lid or panel 118*e* in FIG. 13, depth 123 of the lid or panel is oriented along the same direction as vertical height or rise 113*c* of tier 112*c*, as is the case for all removable lids 118*a-f*, while length 125 of the lid or panel remains oriented along the same direction as length 111*c* of tier 112*c*, as is the case for all removable lids or loose panels 118*a-f*.

When each removable lid or loose panel is in the second or stowed configuration as illustrated by lid or panels 118*a*, *c* and *e* in FIGS. 12-13, the pocket or cavity depth 138 causes a portion of the removable lid or loose panel to protrude upwardly from the top of tier 112*c*. This protrusion allows each removable lid or loose panel to be easily grasped for movement back to the first or display shelf configuration while still allowing trim 140*a-c* on each tier 112*a-c* that is located on the front of the tiers of riser 112 be exposed for viewing.

Retail display unit 100 comprises further elements including a hanging graphic 142 that is supported by a pair of hang brackets 144*a* and 144*b*, which are coupled to a horizontal member 145 of top frame portion 106. In addition, retail display unit 100 includes a cantilevered shelf 146 that is supported by brackets 148*a* and 148*b* that are inserted into slots in upright members 150*a* and 150*b* of center frame portion 108. As illustrated, hanging graphic 142 and cantilevered shelf 146 are both located above riser 112.

Although elements have been shown or described as various embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A retail display unit comprising:

a riser including at least one tier, the at least one tier having a vertical rise, a horizontal width and a horizontal length and including a pocket being defined by a pocket depth, a pocket width and a pocket length that has an open top and an enclosed bottom, the pocket depth being a portion of the vertical rise of the at least one tier, the pocket width being a portion of the horizontal width of the at least one tier, the pocket length being a portion of the horizontal length of the at least one tier; and at least one removable lid being unattached to the riser and the pocket and having a width and a length and being configured into a first configuration and a second configuration, wherein in the first configuration the removable lid covers at least a portion of the open top of the pocket, at least a portion of the horizontal width of the at least one tier and at least a portion of the horizontal length of the at least one tier and wherein in the second configuration the removable lid is located in the pocket and supported by the enclosed bottom of the pocket.

2. The retail display unit of claim 1, wherein each tier of the riser further includes at least one bucket, wherein the at least one bucket is covered by the at least one removable lid when the at least one removable lid is in the first configuration and wherein the at least one bucket is uncovered when the at least one removable lid is in the second configuration.

3. The retail display unit of claim 2, wherein the at least one bucket comprises an open top lip and an enclosed bottom, wherein the open top lip is supported in the tier by a pan having at least one opening and the enclosed bottom is supported in the tier by a tier support.

4. The retail display unit of claim 1, wherein the at least one removable lid comprises a first surface and an opposing second surface, wherein in the first configuration the first surface faces upwardly and the opposing second surface faces downwardly and wherein in the second configuration the first surface faces backwardly and the opposing second surface faces forwardly.

5. The retail display unit of claim 1, wherein when the at least one removable lid is located in the pocket in the second configuration the at least one removable lid is supported by the enclosed bottom of the pocket, extends inside the pocket depth and extends inside the pocket length.

6. The retail display unit of claim 5, wherein the pocket depth is less than the vertical rise of the at least one tier and less than the width of the at least one removable lid such that the at least one removable lid in the second configuration protrudes from the pocket.

7. The retail display unit of claim 1, wherein the at least one removable lid comprises a first removable lid and a second removable lid, the first and second removable lids each cover at least a portion of the horizontal width and at least a portion of the horizontal length of the at least one tier.

8. The retail display unit of claim 7, wherein the first and the second removable lids are both configured in the same first configuration or the same second configuration.

9. The retail display unit of claim 7, wherein the first removable lid is configured in the first configuration while the second removable lid is configured in the second configuration.

10. A retail display unit comprising:

at least one tier having a vertical rise, a horizontal width and a horizontal length and including a cavity being defined by a cavity depth, a cavity width and a cavity length that has an open top and an enclosed bottom, the cavity depth being a portion of the vertical rise of the at least one tier, the cavity width being a portion of the horizontal width of the at least one tier, the cavity length being a portion of the horizontal length of the at least one tier;

at least one loose panel being unattached to the at least one tier and the cavity and having a length and a width and being configurable into a display shelf configuration and a stowed configuration;

wherein in the display shelf configuration the at least one loose panel provides the at least one tier with a display shelf by having the length of the at least one loose panel being located along at least a portion of the horizontal length of the at least one tier, the width of the at least one loose panel being located along at least a portion of the horizontal width of the at least one tier and the at least one loose panel covers at least a portion of the open top of the cavity; and wherein in the stowed configuration the at least one panel is stowed in the cavity and supported by the enclosed bottom of the cavity of the at least one tier.

11. The retail display unit of claim 10, wherein each tier further includes at least one bucket, wherein the at least one bucket is covered by the at least one loose panel when the at least one loose panel is in the display shelf configuration and wherein the at least one bucket is uncovered when the at least one loose panel is in the stowed configuration.

12. The retail display unit of claim 11, wherein the at least one bucket comprises an open top lip and an enclosed bottom, wherein the open top lip is supported in the tier by a pan having at least one opening and the enclosed bottom is supported in the tier by a tier support.

13. The retail display unit of claim 11, wherein the at least one loose panel comprises a first surface and an opposing second surface, wherein in the display shelf configuration the first surface faces upwardly and the opposing second surface faces downwardly and wherein in the stowed configuration the first surface faces backwardly and the opposing second surface faces forwardly.

14. The retail display unit of claim 10, wherein when the at least one loose panel is stowed in the cavity in the stowed configuration the at least one loose panel is supported by the enclosed bottom of the cavity, the width of the at least one loose panel extends inside the cavity depth and the length of the at least one loose panel extends inside the cavity length.

15. The retail display unit of claim 14, wherein the cavity depth is less than the vertical rise of the at least one tier and less than the width of the at least one loose panel such that the at least one loose panel in the stowed configuration protrudes from the cavity.

16. The retail display unit of claim 10, wherein the at least one loose panel includes opposing widthwise sides each having a concave portion for providing finger holds to lift the at least one loose panel.

17. A retail display unit comprising:

a plurality of tiers, each tier having a vertical rise, a horizontal length and a horizontal width and including a cavity being defined by a cavity depth, a cavity width and a cavity length and having an open top and an enclosed bottom, the cavity depth being a portion of the vertical rise of the at least one tier, the cavity width being a portion of the horizontal width of the at least one tier, the cavity length being a portion of the horizontal length of the at least one tier;

at least one loose panel being unattached to each tier and each cavity and being located with each of the tiers, wherein the at least one loose panel is configurable into a display shelf configuration and a stowed configuration;

wherein in the display shelf configuration a length of the at least one loose panel is positioned along at least a portion of a horizontal length of the tier and a width of the at least one loose panel is positioned along at least a portion of a horizontal width of the tier; and wherein in the stowed configuration the at least one loose panel is stowed in the cavity and supported by the enclosed bottom of the cavity.

18. The retail display unit of claim 17, wherein the at least one loose panel comprises a curved portion located on a widthwise edge of the at least one loose panel that provides a finger hold to lift the at least one loose panel.

19. The retail display unit of claim 17, wherein in the display shelf configuration a first surface of the at least one loose panel is oriented to face upwardly and a second opposing surface of the at least one loose panel is oriented to face downwardly.

20. The retail display unit of claim 19, wherein in the stowed configuration the first surface of the at least one loose panel is oriented to face backwardly and the second surface of the at least one loose panel is oriented to face forwardly.

* * * * *